US008293323B2

(12) United States Patent
McKinstry et al.

(10) Patent No.: US 8,293,323 B2
(45) Date of Patent: Oct. 23, 2012

(54) THIN METAL FILM CONDUCTORS AND THEIR MANUFACTURE

(75) Inventors: Susan Trolier McKinstry, State College, PA (US); Clive A. Randall, State College, PA (US); Song Won Ko, State College, PA (US); Michael S. Randall, Simpsonville, SC (US)

(73) Assignee: The Penn State Research Foundation, University Park, PA (US)

( * ) Notice: Subject to any disclaimer, the term of this patent is extended or adjusted under 35 U.S.C. 154(b) by 1284 days.

(21) Appl. No.: 11/710,604

(22) Filed: Feb. 23, 2007

(65) Prior Publication Data

US 2008/0206450 A1 Aug. 28, 2008

(51) Int. Cl.
*B05D 5/12* (2006.01)

(52) U.S. Cl. ..... 427/229; 427/126.1

(58) Field of Classification Search ..... 427/126.1, 427/123, 229, 383.1, 125, 226; 252/500, 252/519.2, 529.21, 529.3
See application file for complete search history.

(56) References Cited

U.S. PATENT DOCUMENTS

| | | | | |
|---|---|---|---|---|
| 4,244,830 | A | 1/1981 | Hennings et al. | |
| 4,880,772 | A | 11/1989 | Pederson et al. | |
| 4,962,088 | A * | 10/1990 | Micheli et al. | 505/446 |
| 5,464,566 | A | 11/1995 | Ito et al. | |
| 5,476,688 | A | 12/1995 | Ostolski | |
| 5,525,264 | A | 6/1996 | Cronin et al. | |
| 5,578,377 | A | 11/1996 | Morimoto et al. | |
| 5,759,230 | A * | 6/1998 | Chow et al. | 75/362 |
| 5,946,551 | A | 8/1999 | Dimitrakopoulos et al. | |
| 6,212,057 | B1 | 4/2001 | Kohara et al. | |
| 6,252,156 | B1 * | 6/2001 | Ono et al. | 136/256 |
| 6,284,434 | B1 | 9/2001 | Kamei et al. | |
| 6,436,479 | B2 | 8/2002 | Takahashi et al. | |
| 6,475,644 | B1 | 11/2002 | Hampikian et al. | |
| 6,482,527 | B1 | 11/2002 | Shrout et al. | |
| 6,649,930 | B2 | 11/2003 | Farrell | |
| 6,781,506 | B2 | 8/2004 | Schemenaur et al. | |
| 6,833,019 | B1 * | 12/2004 | Lewis et al. | 75/345 |
| 6,839,219 | B2 | 1/2005 | Mashiko et al. | |
| 6,853,051 | B2 | 2/2005 | Shioga et al. | |
| 6,887,332 | B1 | 5/2005 | Kagen et al. | |
| 7,012,276 | B2 | 3/2006 | Kingsborough et al. | |
| 7,175,786 | B2 | 2/2007 | Celikkaya et al. | |
| 7,175,876 | B2 | 2/2007 | Free et al. | |
| 7,175,962 | B2 | 2/2007 | Kouchiyama et al. | |
| 7,176,054 | B2 | 2/2007 | Nause et al. | |
| 7,176,069 | B2 | 2/2007 | Yamazaki et al. | |
| 7,176,114 | B2 | 2/2007 | Hill et al. | |
| 7,176,132 | B2 | 2/2007 | Sashida et al. | |
| 7,176,484 | B2 | 2/2007 | Afzali-Ardakani et al. | |
| 2001/0012542 | A1 * | 8/2001 | Takahashi et al. | 427/443.2 |
| 2004/0071882 | A1 * | 4/2004 | Rupich et al. | 427/376.1 |
| 2004/0139820 | A1 | 7/2004 | Kodas et al. | |
| 2004/0202789 | A1 | 10/2004 | Patil et al. | |
| 2006/0084260 | A1 | 4/2006 | Boyers et al. | |
| 2007/0029548 | A1 | 2/2007 | Yamazaki et al. | |
| 2007/0036887 | A1 | 2/2007 | Haase et al. | |

FOREIGN PATENT DOCUMENTS

| | | |
|---|---|---|
| EP | 1 016 459 | 7/2000 |
| EP | 1 375 703 | 1/2004 |
| WO | WO02/085537 | 10/2002 |

* cited by examiner

*Primary Examiner* — Michael Cleveland
*Assistant Examiner* — Tabassom Tadayyon Eslami
(74) *Attorney, Agent, or Firm* — Law Offices John A. Parrish

(57) ABSTRACT

Metal solutions such as copper and nickel suitable for chemical solution deposition (CSD) are disclosed, and their manufacture into low resistivity thin metal films is disclosed. The films may be thermal processed at relatively low temperatures and may be co-fired with ultra low fire high K ceramic dielectrics.

18 Claims, No Drawings

THIN METAL FILM CONDUCTORS AND THEIR MANUFACTURE

FIELD OF THE INVENTION

The present invention relates generally to thin metal film conductors. More particularly, the present invention relates to a method of depositing by a solution-based technique a thin metal film onto a substrate.

BACKGROUND OF THE INVENTION

It is known that dewetting of metal layers on oxide surfaces is a problem even when the metal layers are heat treated at low temperatures. The metal layer should be stable when heat treated at high temperatures.

Copper has been studied as a metallization material for ultra large-scale integration (ULSI) because of its low electrical resistivity and good electromigration resistance. Copper films have been made by chemical vapor deposition, sputtering, and ion beam deposition. A disadvantage of copper, however, is that it is readily oxidized at low temperatures. Oxide formation degrades the electric properties of copper. In addition, copper has poor adhesion to oxide surfaces. Good adhesion between oxide surfaces and metal films is an important factor in achieving good mechanical, thermal, and electronic properties.

The art also has considered use of an intermediate layer between metal and oxide surfaces as a way to improve adhesion. However, the intermediate layer may cause increased electrical resistivity.

The trend in multilayer capacitors ("MLCCs") is toward miniaturization, high capacitance, base metal technology and high volumetric efficiency. MLCCs typically are made by tape casting dispersions of submicron ceramic powders to form layers of dielectric and by screen-printing of submicron metal particulates to form electrodes. Although tape-casting can produce thicknesses as small as 0.8 μm, it is not clear that tape casting can produce layer thicknesses of less than 0.3 μm.

Although the art has produced metallic thin films which have thicknesses as small as 0.8 μm, a need exists for a method of manufacture of thin metal film conductors which have low resistivity at thicknesses of about 0.3 μm or less without the disadvantages of techniques such as sputtering.

SUMMARY OF THE INVENTION

The invention relates to manufacture of thin electrically conductive films. The films include a metallic conductor and a continuity promoter. The metallic conductor may be any of Cu, Ni, Ag, Pd or combinations thereof. The continuity promoter may be any of P, Group IVB transition metals such as Ti, Zr and Hf or mixtures thereof, Group IIB transition metals such as Zn and Cd and mixtures thereof, mixtures of Group IVB and Group IIIB transition metals, as well as mixtures of P with any of Group NB and Group IIIB transition metals.

The films may be made by forming a first solution of a metal precursor in a solvent such as glycol ethers, lower alkanols, lower alkanoic acids, and mixtures thereof, refluxing the first solution to yield a refluxed metal solution, mixing a continuity dopant with the refluxed metal solution to yield a doped solution, depositing the doped solution onto an insulating substrate to yield a wet film on the substrate, pyrolyzing the wet film to yield a pyrolyzed film, and annealing the pyrolyzed film in a reducing atmosphere, a inert atmosphere and mixtures thereof. The first solution may include a high work function dopant such as Pt, Ir and Au to tailor insulation resistance of the dielectric and the dielectric/electrode barrier height. The metal precursor may be any of copper precursors, nickel precursors, silver precursors, nickel precursors and mixtures thereof. The films have thickness of under 300 nm and excellent conductivity.

The metal films may be used in single or multilayer electronic devices (MLCCs, varistors or the like), capacitors, transistors (of which there are many types, including junction transistors and thin film transistors), diodes (for example, light emitting diodes or Schottky diodes), photovoltaics, and displays. The metal films may be heat treated at relatively low temperatures and may be co-fired in combination with ultra low fire high K ceramic dielectrics such as sol gel barium titanate.

DETAILED DESCRIPTION OF THE INVENTION

Generally, thin metal films of thicknesses as low as about 20 nm may be made by forming a solution of one or more metallic conductors to produce a metal conductor solution. The typical molarity the metal conductor solution is about 0.05M to about 1M. The metal conductor solution is refluxed and then one or more continuity dopant precursors are added to the solution to produce a doped solution. The typical amount of continuity dopants in the doped solution is about 0.005M to about 0.3M. Optional high work function dopants such as Pt, Ir and Au in amounts of about 1 m/o to about 20 mol/o may added to the doped solution to control the barrier height of the electric/dielectric interface. The resulting solution is deposited such as by spin casting onto a substrate to yield wet film thicknesses typically of about 5 nm to about 200 nm. The wet film then is pyrolyzed and annealed.

In a first aspect, doped Cu based thin films are disclosed. The doped Cu based films may include continuity dopants such as Group IVB transition metals such as Ti, Zr, Hf, and mixtures thereof, Group IIB transition metals such as Zn and Cd and mixtures thereof, as well as with mixtures of Group NB and Group IIIB transition metals, or P. Mixtures of P with any of Group IVB and Group IIIB transition metal also may be employed. Preferably, the transition metals employed include any of Ti, Zr and Zn, most preferably Zr. The Zr, Zn and Ti continuity dopants, and mixtures thereof each may be present in the doped Cu based thin films in amounts of upto about 50 m/o, preferably about 0.1 m/o to about 30 m/o.

In a second aspect, doped Ni based thin films are disclosed. The Ni based films may include continuity dopants such as Group IVB transition metals such as Ti, Zr, Hf, and mixtures thereof, Group IIB transition metals such as Zn and Cd and mixtures thereof, as well as mixtures of Group IVB and Group IIIB transition metals, or P. Mixtures of P with any of Group IVB and Group IIIB transition metal also may be employed. Preferably, the transition metals employed include any of Ti, Zr and Zn, most preferably Zr. The Zr, Zn and Ti continuity dopants, and mixtures thereof each may be present in the doped Ni based thin films in amounts of up to about 50 m/o, preferably about 0.1 m/o to about 30 m/o.

In a third aspect, doped Cu-Ni based thin films are disclosed. The Ni-Cu based films have the formula $Cu_{1-x}Ni_x$ ($0 \leqq x \leqq 0.5$) and may include continuity dopants such as Group IVB transition metals such as Ti, Zr Hf, and mixtures thereof, Group IIB transition metals such as Zn and Cd and mixtures thereof, as well as mixtures of Group IVB and Group IIIB transition metals, or P. Mixtures of P with any of Group IVB and Group IIIB transition metal also may be employed. Preferably, the transition metals employed include any of Ti, Zr and Zn, most preferably Zr. The Zr, Zn and Ti continuity dopants, and mixtures thereof each may be present in the doped Cu-Ni based thin films in amounts of up to about 50 m/o, preferably about 0.1 m/o to about 30 m/o.

Manufacture of Cu Thin Films Having Ti Continuity Dopant

Generally, in manufacture of Ti doped Cu thin films having about 0.1 m/o to about 50 m/o, preferably about 0.1 m/o to about 30 m/o, more preferably about 5 m/o to about 10 m/o Ti continuity dopant, a Cu precursor such as any of copper acetate, copper acetylacetonate, copper hexafluoroacetylacetonate, copper nitrate hydrate, copper chloride, copper 2-ethylhexanoate or mixtures thereof is dissolved in a solvent to produce a Cu solution. Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof preferably 2-methoxyethanol, lower alkanols such as methanol, ethanol, butanol, propanol or mixtures thereof as well as lower alkanoic acids such as acetic acid, propionic acid, butyric acid, valeric acid, myristic acid, or mixtures thereof. Mixtures of glycol ethers, lower alkanols and lower alkanoic acids also may be employed. Generally, about 0.01 mol to about 3 mol of a Cu precursor may be added per liter of solvent. Where the copper solution includes copper nitrate hydrate and 2-methoxyethanol, copper nitrate hydrate may be present in an amount of about 0.01 mol to about 3 mol per liter of copper solution, preferably about 0.1 mol to about 1 mol per liter of copper solution, more preferably about 0.2 mol to about 0.5 mol per liter of copper solution. The resulting copper solution is refluxed for about 0.1 hr to about 20 hrs, preferably about 0.5 hr to about 5 hr, more preferably about one hr at about 100° C. to about 160° C., preferably about 100° C. to about 120° C., more preferably about 105° C. to produce a first refluxed copper solution. Then, a Ti precursor such as any of Ti isopropoxide Ti chloride, Ti ethoxide, Ti methoxide, Ti propoxide, Ti butoxide, or mixtures thereof, preferably Ti isopropoxide, is added to that first refluxed copper solution and again refluxed to produce a second refluxed solution. A precursor of a high work function dopant such as Pt, Ir and Au optionally may be added to the second refluxed solution in amounts sufficient to achieve about 0.1 m/o to about 20 m/o of work function dopant where it is desired to better control the barrier height of the electric/dielectric interface between the deposited film and the substrate. Precursors of high work function dopants which may be employed include but are not limited Iridium acetylacetonate, Iridium chloride, Iridium chloride hydrate, Gold chloride, Gold chloride hydrate, Gold chloride tirhydrate, Platinum acetylacetonate and Platinum chloride.

The second refluxed solution is concentrated by evaporation. The concentrated refluxed solution is mixed with a solvent such as a glycol ether such as any of 2-methoxyethanol, or 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof, preferably 2-methoxyethanol and stirred at about 0° C. to about 100° C., preferably at about 30° C. to about 40° C. to produce a Ti-doped copper solution.

The Ti-doped copper solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or the like, as well as BaTiO) $SiO_2$/Si substrates. The Ti-doped copper solution may be deposited by methods such as micropad stamping, mist deposition, ink jet printing, spraying, and by spin coating, preferably spin coating to produce a film bearing substrate.

Spin coating typically may be performed by a spinner such as that from Headway Research Inc. at about 1000 RPM to about 6000 RPM, preferably about 1000 RPM to about 4000 RPM, more preferably at about 3000 RPM. Spin coating may be performed at a temperature of about 0° C. to about 90° C., preferably about 10° C. to about 50° C., more preferably at about 25° C. for about 20 sec to about 200 sec, preferably about 0.5 min to about 1 min, more preferably about 30 sec in atmospheres such as air, oxygen, neutral or reducing atmospheres, preferably air.

The film on the substrate then is pyrolyzed in atmospheres such as air, N2 or N2+H2, preferably air at temperatures of about 150° C. to about 500° C., preferably about 180° C. to about 400° C., more preferably about 280° C. The resulting pyrolyzed film then is annealed.

Annealing may be performed by heating at about 1° C./min to about 50° C./min, preferably 3° C./min to about 15° C./min, more preferably about 5° C./min to a maximum temperature of about 400° C. to about 700° C., preferably about 450° C. to about 550° C., more preferably about 500° C., holding at that maximum temperature for about 1 min to about 120 min, preferably about 1 min to about 30 min, more preferably about 6 min, and cooling at about 1° C./min to about 50° C./min, preferably about 3° C./min to about 15° C./min, more preferably about 5° C./min to room temperature. The annealing may be performed in a reducing atmosphere such as one that includes a mixture of hydrogen, wet nitrogen (a gaseous mixture of nitrogen and water vapor (dew point of about −8° C. to about 32° C.)) and dry nitrogen (ultra high purity nitrogen having a purity of about 99.999%). Dry nitrogen and hydrogen gases are available from GTS incorporation. Wet nitrogen is made by passing dry nitrogen through distilled water. Mixtures of H, wet N2 and dry N2 are made by using a mass flow controllers for each gas. Other reducing atmospheres which may be employed include but are not limited to CO and mixtures of CO and $CO_2$. Inert atmospheres also may be employed. Examples of inert atmospheres which may be employed include but are not limited to Ar, $N_2$, He, Kr and mixtures thereof. In a reducing atmosphere formed of a mixture of hydrogen, wet nitrogen and dry nitrogen, hydrogen may be present in an amount of up to about 10 vol. %, wet nitrogen may be present in an amount of up to about 40 vol. %, and dry nitrogen may be present in an amount of up to about 90 vol. %, all amounts based on the total volume of the reducing atmosphere employed.

Manufacture of Zn Doped Cu Thin Films

Generally, in manufacture of Zn doped Cu thin films having about 0.1 m/o to about 30 m/o, preferably about 5 m/o to about 10 m/o Zn continuity promoter, a Cu precursor such as any of copper acetate, copper acetylacetonate, copper hexafluoroacetylacetonate, copper nitrate hydrate, copper chloride, copper 2-ethylhexanoate or mixtures thereof is dissolved in a solvent. Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof preferably 2-methoxyethanol, lower alkanols such as methanol, ethanol, butanol, propanol or mixtures thereof as well as lower alkanoic acids such as acetic acid, propionic acid, butyric acid, valeric acid, myristic acid or mixtures thereof.

Generally, about 0.01 mol to about 3 mol per liter of copper solution, preferably about 0.1 mol to about 1 mol per liter of copper solution, more preferably about 0.2 mol to about 0.5 mol per liter of copper solution may be employed. Where the copper solution includes copper nitrate hydrate and 2-methoxyethanol, copper nitrate hydrate may be present in an amount of about 0.01 mol to about 3 mol per liter of copper solution, preferably about 0.1 mol to about 1 mol per liter of copper solution, more preferably about 0.2 mol to about 0.5 mol per liter of copper solution. The resulting copper solution is refluxed for about 0.1 hr to about 20 hrs, preferably about 1 hr to about 5 hr, more preferably about one hr at about 100° C. to about 160° C., preferably about 100° C. to about 120° C., more preferably about 105° C. to produce a first refluxed copper solution. Then, a Zn precursor such as any of zinc acetate, zinc acetylacetonate hydrate, zinc chloride and zinc acetate dihydrate, or mixtures thereof, preferably zinc acetate dihydrate is added to that first refluxed copper solution and again refluxed to produce a second refluxed solution. A precursor of a high work function dopant such as Pt, Ir and Au optionally may be added to the second refluxed solution in amounts sufficient to achieve about 0.1 m/o to about 20 m/o of work function dopant where it is desired to better control the barrier height of the electric/dielectric interface between the deposited film and the substrate.

The second refluxed solution is concentrated by evaporation. The concentrated refluxed solution is mixed with a solvent such as a glycol ether such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof, preferably 2-methoxyethanol and stirred at about 0° C. to about 100° C., preferably at about 30-40° C. to produce a Zn-doped copper solution. The Zn-doped copper solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or a $SiO_2$/Si substrate by methods such as micropad stamping, spraying, ink jet printing, and spin coating. Preferably, the film is deposited by spin coating. Spin coating may be performed as described above for manufacture of Ti doped copper based thin films. The film then may be pyrolyzed and annealed as described above for manufacture of Ti doped copper based thin films.

Manufacture of Zr Doped Cu Thin Films

Generally, in manufacture of Zr doped Cu thin films having about 0.1 m/o to about 50 m/o, preferably about 5 m/o to about 30 m/o Zr continuity promoter, a Cu precursor such as any of copper acetate, copper acetylacetonate, copper hexafluoroacetylacetonate, copper nitrate hydrate, copper chloride, copper 2-ethylhexanoate or mixtures thereof is dissolved in a solvent. Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof, preferably 2-methoxyethanol, lower alkanols such as methanol, ethanol, butanol, propanol or mixtures thereof as well as lower alkanoic acids such as acetic acid, propionic acid, butyric acid, valeric acid, myristic acid or mixtures thereof.

Where the copper solution includes copper nitrate hydrate and 2-methoxyethanol, copper nitrate hydrate may be present in an amount of about 0.01 mol to about 3 mol per liter of copper solution, preferably about 0.1 mol to about 1 mol per liter of copper solution, more preferably about 0.2 mol to about 0.5 mol per liter of copper solution.

The resulting Cu solution is refluxed for about 0.1 hr to about 20 hrs, preferably about 0.5 hr to about 5 hr, more preferably about one hr at about 100° C. to about 160° C., preferably about 100° C. to about 120° C., more preferably about 105° C. to produce a first refluxed Cu solution. Then, a Zr precursor such as any of Zr propoxide (Aldrich, 70 wt % solution in 1-propanol) zirconium acetate, zirconium acetylacetonate, zirconium isopropoxide, zirconium chloride, and zirconium ethoxide and mixtures thereof, preferably Zr propoxide (Aldrich, 70 wt % solution in 1-propanol) is added to that first refluxed Cu solution and again refluxed to produce a second refluxed solution. A precursor of a high work function dopant such as Pt and Au optionally may be added to the second refluxed solution in amounts sufficient to achieve about 0.1 m/o to about 20 ml/o of work function dopant where it is desired to better control the barrier height of the electric/dielectric interface between the deposited film and the substrate.

The second refluxed solution is concentrated by evaporation. The concentrated refluxed solution is mixed with a solvent such as a glycol ether such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof, preferably 2-methoxyethanol and stirred at about 0° C. to about 100° C., preferably at about 30° C. to about 40° C. to produce a Zr-doped Cu solution. The Zr-doped Cu solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or the like, or a $SiO_2$/Si substrate by methods such as micropad stamping and spin coating, preferably spin coating. Spin coating may be performed as described above for manufacture of Ti doped copper based thin films. The film then may be pyrolyzed and annealed as described above for manufacture of Ti doped copper based thin films. Alternatively, the pyrolyzed film Zr doped Cu may be annealed by a modified annealing procedure.

The modified annealing procedure entails a first step of heating the pyrolyzed film at about 1° C./min to about 600° C./min, preferably about 3° C./min to about 15° C./min, more preferably about 5° C./min to a maximum temperature of about 300° C. to about 800° C., preferably about 400° C. to about 600° C., more preferably about 500° C., holding at the maximum temperature for about 1 min to about 120 min, preferably about 5 min to about 30 min, more preferably about 500° C. for about 6 min, and cooling at about 1° C./min to about 600° C./min, preferably about 3° C./min to about 15° C./min, more preferably about 5° C./min to room temperature, and holding at room temperature for 60 sec.

In the second step of the modified annealing procedure, the film is heated at about 1° C./min to about 600° C./min, preferably at about 3° C./min to about 50° C./min, more preferably at about 5° C./min a maximum temperature of about 800° C. to about 1200° C., preferably about 850° C. to about 1000° C., more preferably about 900° C., holding at the maximum temperature for about 1 min to about 120 min, preferably about 30 min to about 90 min, more preferably about 60 min, and cooling at about 1° C./min to about 600° C./min, preferably about 3° C./min to about 50° C./min, more preferably about 5° C./min to room temperature.

The first step of the modified annealing procedure is performed in reducing atmosphere such a mixture of hydrogen, wet nitrogen and dry nitrogen such as one having $H_2$ 20 sccm, wet $N_2$ 50 sccm, and dry $N_2$ 430 sccm. The second step of the modified annealing procedure is performed in reduced partial pressure of oxygen such as one have an oxygen partial pressure of about $10^{-17}$ atm.

Manufacture of Ti Doped Ni Films

Generally, in manufacture of Ti doped Ni thin films, a Ni precursor such as any of nickel acetate, nickel acetylacetonate, nickel hexafluoroacetylacetonate, nickel nitrate hydrate, Nickel chloride, Nickel 2-ethylhexanoate, preferably nickel acetate or mixtures thereof is dissolved in a solvent. Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof preferably 2-methoxyethanol, lower alkanols such as methanol, ethanol, butanol, propanol or mixtures thereof as well as lower alkanoic acids such as acetic acid, propionic acid, butyric acid, valeric acid, myristic acid, or mixtures thereof. Mixtures of glycol ethers, lower alkanols and lower alkanoic acids also may be employed. Where the nickel solution includes nickel acetate and 2-methoxyethanol, nickel acetate may be present in an amount of about 0.01 mol to about 3 mol per liter of nickel solution, preferably about 0.1 mol to about 1 mol per liter of copper solution, more preferably about 0.2 mol to about 0.5 mol per liter of nickel solution.

The resulting nickel solution is refluxed for about 0.1 hr to about 20 hrs, preferably about 0.5 hr to about 5 hr, more preferably about one hr at about 100° C. to about 150° C., preferably about 100° C. to about 120° C., more preferably about 105° C. to produce a first refluxed nickel solution. Then, a Ti precursor such as any of Ti isopropoxide, Ti chloride, Ti ethoxide, Ti methoxide, Ti propoxide, Ti butoxide, and mixtures thereof, preferably Ti isopropoxide, is added to that first refluxed nickel solution and again refluxed to produce a second refluxed solution. A precursor of a high work function dopant such as Pt and Au optionally may be added to the second refluxed solution in amounts sufficient to achieve about 0.1 m/o to about 20 m/o of work function dopant where it is desired to better control the barrier height of the electric/dielectric interface between the deposited film and the substrate.

The second refluxed solution is concentrated by evaporation. The concentrated refluxed solution is mixed with a solvent such as a glycol ether such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl, or mixtures thereof, preferably 2-methoxyethanol stirred at about 0° C. to about 100° C., preferably about 30° C. to about 40° C. to produce a Ti-doped nickel solution. The Ti-doped nickel solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or the like, preferably a $BaTiO_3SiO_2$/Si substrate.

The Ti-doped nickel solution may be deposited by methods such as micropad stamping, spraying, ink jet printing, and by spin coating to produce a film bearing substrate. Preferably, the film is deposited by spin coating. Spin coating may be performed as described above for manufacture of Ti doped copper based thin films. The film then may be pyrolyzed and annealed as described above for manufacture of Ti doped copper based thin films.

Manufacture of Zn Doped Ni Thin Films

Generally, in manufacture of Zn doped Ni thin films, a Ni precursor such as any of nickel acetate, nickel acetylacetonate, nickel hexafluoroacetylacetonate, nickel nitrate hydrate, nickel chloride, nickel 2-ethylhexanoate, or mixtures thereof, preferably nickel acetate, or mixtures thereof is dissolved in a solvent. Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof preferably 2-methoxyethanol, lower alkanols such as methanol, ethanol, butanol, propanol or mixtures thereof as well as lower alkanoic acids such as acetic acid, propionic acid, butyric acid, valeric acid, myristic acid, or mixtures thereof. Where the nickel solution includes nickel acetate and 2-methoxyethanol, nickel acetate may be present in an amount of about 0.01 mol to about 3 mol per liter of nickel solution, preferably about 0.1 mol to about 1 mol per liter of nickel solution, more preferably about 0.2 mol to about 0.5 mol per liter of nickel solution.

The resulting nickel solution is refluxed for about 0.1 hr to about 20 hrs, preferably about 0.5 hr to about 5 hr, more preferably about one hr at about 100° C. to about 160° C., preferably about 100° C. to about 120° C., more preferably about 105° C. to produce a first refluxed nickel solution. Then, a Zn precursor such as any of zinc acetate, zinc acetylacetonate hydrate, zinc chloride, zinc acetate dihydrate and mixtures thereof, preferably zinc acetate dihydrate is added to that first refluxed nickel solution and again refluxed to produce a second refluxed solution. A precursor of a high work function dopant such as Pt and Au optionally may be added to the second refluxed solution in amounts sufficient to achieve about 0.1 m/o to about 20 m/o of work function dopant of about 0.1 m/o to about 20 m/o where it is desired to better control the barrier height of the electric/dielectric interface between the deposited film and the substrate.

The second refluxed solution is concentrated by evaporation. The concentrated refluxed solution is mixed with a solvent such as a glycol ether such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl, or mixtures thereof, preferably 2-methoxyethanol and stirred at about 0° C. to about 100° C., preferably about 30° C. to about 40° C. to produce a Zn-doped Ni solution. The Zn-doped nickel solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or the like, preferably $SiO_2$/Si substrate by methods such as micropad stamping, spraying, ink jet printing, and spin coating. Preferably, the film is deposited by spin coating. Spin coating may be performed as described above for manufacture of Ti doped copper based thin films. The film then may be pyrolyzed and annealed as described above for manufacture of Ti doped copper based thin films.

Manufacture of Zr Doped Ni Thin Films

Generally, in manufacture of Zr doped Ni thin films, a Ni precursor such as any of nickel acetate, nickel acetylacetonate, nickel hexafluoroacetylacetonate, nickel nitrate hydrate, nickel chloride, nickel 2-ethylhexanoate, or mixtures thereof, preferably nickel acetate or mixtures thereof is dissolved in a solvent. Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof, preferably 2-methoxyethanol, lower alkanols such as methanol, ethanol, butanol, propanol or mixtures thereof as well as lower alkanoic acids such as acetic acid, propionic acid, butyric acid, valeric acid, myristic acid or mixtures thereof. Mixtures of glycol ethers, lower alkanols and lower alkanoic acids also may be employed. Where the nickel solution includes nickel acetate and 2-methoxyethanol, nickel acetate may be present in an amount of about 0.01 mol to about 3 mol per liter of nickel solution, preferably about 0.1 mol to about 1 mol per liter of nickel solution, more preferably about 0.2 mol to about 0.5 mol per liter of nickel solution.

The resulting Ni solution is refluxed for about 0.1 hr to about 20 hrs, preferably about 0.5 hr to about 5 hr, more preferably about one hr at about 100° C. to about 160° C., preferably about 100° C. to about 120° C., more preferably about 105° C. to produce a first refluxed Ni solution. Then, a Zr precursor such as any of Zr propoxide (Aldrich, 70 wt % solution in 1-propanol) zirconium acetate, zirconium acetylacetonate, zirconium isopropoxide, zirconium chloride, and zirconium ethoxide, and mixtures thereof, preferably Zr propoxide (Aldrich, 70 wt % solution in 1-propanol) is added to that first refluxed Ni solution and again refluxed to produce a second refluxed solution. A precursor of a high work function dopant such as Pt and Au optionally may be added to the second refluxed solution in amounts of about 0.1 m/o to about 20 m/o where it is desired to better control the barrier height of the electric/dielectric interface between the deposited film and the substrate.

The second refluxed solution is concentrated by evaporation. The concentrated refluxed solution is mixed with a solvent such as a glycol ether such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl, or mixtures thereof, preferably 2-methoxyethanol and stirred at 30-40° C. to produce a Zr-doped Ni solution. The Zr-doped nickel solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or the like, or a $SiO_2$/Si substrate by methods such as micropad stamping and spin coating. Preferably, the film is deposited by spin coating. Spin coating may be performed as described above for manufacture of Ti doped copper based thin films.

The film then may be pyrolyzed and annealed as described above for manufacture of Ti doped copper based thin films. Alternatively, the pyrolyzed film may be annealed by a modified annealing procedure as employed in manufacture of Zr doped Cu films.

Manufacture of Doped $Cu_{1-x}Ni_x$ ($0 \leqq x \leqq 0.5$) films

Doped $Cu_{1-x}Ni_x$ ($0 \leqq x \leqq 0.5$) films may be made using the procedures above for manufacture of doped Cu films and doped Ni films. In this aspect, a copper precursor such as copper acetate, copper acetylacetonate, copper hexafluoroacetylacetonate, copper nitrate hydrate, copper chloride, copper 2-ethylhexanoate, and mixtures thereof, preferably copper nitrate hydrate and a nickel precursor such as nickel nitrate hydrate, nickel chloride, nickel 2-ethylhexanoate, and mixtures thereof, preferably nickel nitrate hydrate are dissolved in a solvent to produce a Cu—Ni solution.

Useful solvents include but are not limited to solvents such as any of glycol ethers such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl or mixtures thereof preferably 2-methoxyethanol, lower alkanols such as methanol, ethanol, butanol, propanol or mixtures thereof as well as lower alkanoic acids such as acetic acid, propionic acid, butyric acid, valeric acid, myristic acid or mixtures thereof. Mixtures of glycol ethers, lower alkanols and lower alkanoic acids also may be employed.

Where the Cu—Ni solution includes copper nitrate hydrate and nickel nitrate hydrate in 2-methoxyethanol, copper nitrate hydrate may be present in an amount of about 0.01 mol to about 3 mol per liter of copper-nickel solution, preferably about 0.1 mol to about 1 mol per liter of copper-nickel solution, more preferably about 0.2 mol to about 0.5 mol per liter of copper-nickel solution and nickel nitrate hydrate may be present in an amount of about 0.01 mol to about 3 mol per liter of copper-nickel solution, preferably about 0.1 mol to about 1 mol per liter of copper-nickel solution, more preferably about 0.2 mol to about 0.5 mol per liter of copper-nickel solution. The resulting $Cu_{1-x}Ni_x$ ($0 \leqq x \leqq 0.5$) solution is refluxed at about 100° C. to about 160° C. for about 6 min to about 1000 min, preferably at about 105° C. for about 60 min to produce a first refluxed solution. Then, a dopant precursor such as any of Zr propoxide (Aldrich, 70 wt % solution in 1-propanol) zirconium acetate, zirconium acetylacetonate, zirconium isopropoxide, zirconium chloride, and zirconium ethoxide, zinc acetate, zinc acetylacetonate hydrate, zinc chloride and zinc acetate dihydrate, Ti isopropoxide and mixtures thereof is added to the first refluxed Ni—Cu solution and again refluxed to produce a second refluxed solution. A precursor of a high work function dopant such as Pt and Au optionally may be added to the second refluxed solution in amounts in amounts sufficient to achieve about 0.1 m/o to about 20 m/o of work function dopant where it is desired to better control the barrier height of the electric/dielectric interface between the deposited film and the substrate.

The second refluxed solution is concentrated by evaporation. Then, the concentrated refluxed solution is mixed with a solvent such as glycol ether such as any of 2-methoxyethanol, 2-ethoxyethanol, 2-propoxyethanol, 2-isopropoxyethanol, 2-butoxyethanol, 2-phenoxyethanol, 2-benzyloxyethanol and diethylene glycol monoethyl ethyl, or mixtures thereof, preferably 2-methoxyethanol and stirred at about 0° C. to about 100° C., preferably about 30° C. to about 40° C. to produce a doped Cu—Ni solution.

The doped Cu—Ni solution then is deposited onto an insulating substrate such as doped or undoped $Al_2O_3$, MgO, $BaTiO_3$ or the like or conducting substrates such as Ni foil, Cu foil, Pt foil or Al foil coated with insulators such as doped or undoped $Al_2O_3$, MgO, $BaTiO_3$ or the like, or a $SiO_2$/Si substrate by methods such as micropad stamping, ink jet printing, spraying, and spin coating. Preferably, the film is deposited by spin coating. Spin coating may be performed as described above for manufacture of Ti doped copper based thin films. The film then may be pyrolyzed and annealed as described above for manufacture of Ti doped copper based thin films and Zr doped copper based films.

In another aspect, the invention relates to manufacture of doped Ni—Cu films such as Zr doped Ni—Cu films of the formula $Cu_{1-x}Ni_x$ where $0<x<1$. The doped Ni—Cu films may be made by dissolving a copper precursor and a nickel precursor in a glycol ether solvent produce a Cu—Ni solution, refluxing the Cu—Ni solution to produce a first refluxed Cu—Ni solution, adding a Zr continuity dopant precursor to the refluxed Cu—Ni solution to produce a second refluxed solution, depositing the second refluxed solution onto an insulating substrate to produce a wet film, heating the wet film to produce a pyrolyzed film, and annealing the pyrolyzed film.

The invention is described in further detail below by reference to the following non-limiting examples.

EXAMPLES 1-2 ILLUSTRATE MANUFACTURE OF Ti DOPED Cu THIN FILM

Example 1

250 nm Thick, 5 m/o Ti Doped Cu Film on $BaTiO_3SiO_2/Si$ Substrate 2.0933 gm copper nitrate hydrate (Aldrich, 99.999%) is dissolved in 30 ml 2-methoxyethanol (Aldrich, 99.9%) and the resulting Cu solution is refluxed at 105° C. for 60 min to produce a first refluxed Cu solution. Then, 0.1279 g Ti isopropoxide (Aldrich, 99.999%) is added to that first refluxed Cu solution and then again refluxed at 105° C. for 30 min to produce a second refluxed solution. The second refluxed solution is evaporated to produce 10 ml of concentrated refluxed solution. Then, 20 ml of 2-methoxyethanol is added to the second refluxed solution and stirred at 30° C.-40° C. The resulting Ti-doped Cu solution is deposited onto a $BaTiO_3/SiO_2/Si$ substrate by spin coating to produce a film bearing substrate. The $BaTiO_3/SiO_2/Si$ substrate is prepared by spin coating a solution of $BaTiO_3$ onto a $SiO_3/Si$ substrate.

Spin coating of the Ti-doped Cu solution onto the BaTiO) $SiO_2/Si$ substrate is performed by a spinner (Headway Research Inc.) at 3000 RPM at 25° C. for 0.5 min in air. The deposited film on the $BaTiO_3/SiO_2/Si$ substrate then is pyrolyzed in air by placing the substrate on a hot plate at 280° C., holding at 280° C. for 180 seconds, and then removing from the substrate from the hot plate and allowing the substrate to cool in an air to room temperature. The resulting pyrolyzed film is annealed by heating at 5° C./min to 500° C., holding at 500° C. for 6 min, and cooling at 5° C./min to room temperature. The annealing is performed in reducing atmosphere ($H_2$ 20 sccm, wet $N_2$ 50 sccm, dry $N_2$ 430 sccm) to produce a 5 m/o Ti doped Cu film that has a thickness of 250 nm.

The resistivity of the film is 50 μΩ-cm as measured by ASTM method ACTIVE STANDARD: F390-98(2003) Standard Test Method for Sheet Resistance of Thin Metallic Films With a Collinear Four-Probe Array ("4-point method").

Example 2

250 nm Thick, 10 m/o Ti Doped Cu Film on BaTiO)$SiO_2/Si$ Substrate

The procedure of example 1 is employed except that 2.0933 gm copper nitrate hydrate is dissolved in 30 ml 2-methoxyethanol and the resulting Cu solution is refluxed at 105° C. for 60 min to produce a first refluxed solution. Then, 0.2558 g Ti isopropoxide is added to that first refluxed Cu solution and then again refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C. The resulting Ti-doped Cu solution is deposited onto a $BaTiO_3/SiO_2/Si$ substrate, prepared as in example 1, to produce a film bearing substrate. The deposited film on the substrate then is pyrolyzed and annealed as in example 1 to produce a 10 m/o Ti doped Cu film having a thickness of 250 nm and a resistivity of 150,4n-cm.

EXAMPLES 3-4 ILLUSTRATE MANUFACTURE OF Zn DOPED Cu THIN FILM

Example 3

60 nm Thick 30 m/o Zn Doped Cu Film on $SiO_2/Si$ Substrate 2.0933 gm copper nitrate hydrate is dissolved in 30 ml 2-methoxyethanol and the resulting Cu solution is refluxed at 105° C. for 60 min to produce a refluxed Cu solution. Then, 0.5928 gm zinc acetate hydrate (Aldrich, 99.999%) is added to the refluxed Cu solution and the resulting solution is refluxed at 105° C. for 30 min to produce a refluxed Zn doped Cu solution. The second refluxed solution is evaporated to produce 10 ml of concentrated refluxed solution. Then, 20 ml of 2-methoxyethanol is added to the concentrated refluxed solution and stirred at 30-40° C.

The resulting Zn doped Cu solution is deposited onto a $SiO_2/Si$ substrate (Nova Electronic Materials) and spin coated as in example 1 to produce a film bearing substrate. The deposited film on the substrate then is pyrolyzed and annealed as in example 1 to produce a 30 m/o Zn doped Cu film having a thickness of 60 nm and a resistivity of 11 μΩ-cm as measured by the 4-point method.

Example 4

60 nm Thick 5 m/o Zn Doped Cu Film on $SiO_2/Si$ Substrate 2.0933 gm copper nitrate hydrate is dissolved in 30 ml 2-methoxyethanol and the resulting Cu solution is refluxed at 105° C. for 60 min to produce a refluxed Cu solution. Then, 0.0988 gm zinc acetate hydrate is added to the refluxed Cu solution and the resulting solution is refluxed at 105° C. for 30 min to produce a refluxed Zn doped Cu solution. The refluxed Zn doped Cu solution is evaporated until 10 ml remains. Then, 20 ml of 2-methoxyethanol is added to the concentrated refluxed solution and stirred at 30-40° C. The resulting Zn doped Cu solution is deposited onto a $SiO_2/Si$ substrate and spin coated as in example 1 to produce a film bearing substrate. The deposited film on the substrate then is pyrolyzed and annealed as in example 1 to produce a 5 m/o Zn doped Cu film having a thickness of 60 nm and a resistivity of 7 μΩ-cm as measured by the 4-point method.

EXAMPLES 5-9A ILLUSTRATE MANUFACTURE OF Zr DOPED Cu THIN FILMS

Example 5

80 nm Thick, 7.5 m/o Zr Doped Cu Film on $SiO_2/Si$ Substrate 2.0933 gm copper nitrate hydrate is dissolved in 20 ml 2-methoxyethanol and the resulting Cu solution is refluxed at 105° C. for 60 min to produce a refluxed Cu solution. 0.3159 g Zirconium (IV) propoxide solution (70 wt. % in 1-propanol) (Aldrich) is added to the refluxed Cu solution and the resulting solution is refluxed at 105° C. for 30 min to produce a refluxed Zr doped Cu solution. The second refluxed solution is evaporated to produce 10 ml of concentrated refluxed solution. Then, 20 ml of 2-methoxymethanol is added to the concentrated refluxed solution and stirred at 30-40° C. The resulting Zr doped Cu solution is deposited onto a $SiO_2/Si$ substrate and spin coated as in example 1 to produce a film bearing substrate. The deposited film on the substrate then is pyrolyzed and annealed as in example 1 to produce a 7.5 ml/o Zr doped Cu film having a thickness of 80 nm and a resistivity of 126 μΩ-cm as measured by the 4-point method.

Example 5A 80 nm Thick, 7.5 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.3159 g Zirconium (IV) propoxide solution (70 wt. % in 1-propanol) is added to the refluxed Cu solution and the resulting solution is refluxed at 105° C. for 30 min to produce a second refluxed solution. The second refluxed solution is evaporated to produce 10 ml of concentrated refluxed solution. Then, 20 ml of 2-methoxyethanol is added to the concentrated refluxed solution and stirred at 30-40° C. The resulting Zr doped Cu solution is deposited onto a $SiO_2$/Si substrate by spin coating as in example 1 to produce a film bearing substrate. The deposited film on the substrate then is pyrolyzed as in example 1.

The resulting pyrolyzed film then is subjected to a modified annealing procedure. The first step of the modified annealing procedure entails heating at 5° C./min to 500° C., holding at 500° C. for 6 min, cooling 5° C./min to room temperature, and holding at room temperature for 60 sec. The second step of the modified annealing procedure entails heating the film at 5° C./min to 900° C., holding at 900° C. for 60 min, and cooling at 5° C./min to room temperature.

The first step of the modified annealing procedure is performed in reducing atmosphere ($H_2$ 20 sccm, wet $N_2$ 50 sccm, dry $N_2$ 430 sccm). The second step of the procedure is performed in an oxygen partial pressure of $10^{-17}$ atm.

The resulting annealed 7.5 m/o Zr doped Cu film has a thickness of 80 nm and a resistivity of 27 μΩ-cm.

Example 6

80 nm Thick, 10 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.4212 g Zirconium (IV) propoxide solution (70 wt. % in 1-propanol) is added to the refluxed Cu solution and the resulting solution is refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C.

The resulting Zr doped Cu solution is deposited onto a $SiO_2$/Si substrate and spin coated as in example 1 to produce a film bearing substrate. The deposited film on the substrate then is pyrolyzed and annealed as in example 1 to produce a 10 m/o Zr doped Cu film having a thickness of 80 nm and a resistivity of 29 AD-cm as measured by the 4-point method.

Example 6A 80 nm Thick, 10 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.4212 g Zirconium (IV) propoxide solution (70 wt. % in 1-propanol) is added to the refluxed Cu solution and the resulting solution is refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C. The resulting Zr doped Cu solution is deposited onto a $SiO_2$/Si substrate by spin coating as in example 1. The deposited film then is pyrolyzed as in example 1. The pyrolyzed film then is annealed according to the modified annealing procedure of example 5A to produce a 10 ml/o Zr doped Cu film having a thickness of 80 nm and a resistivity of 8 μΩ-cm as measured by the 4-point method.

Example 6B 50 nm Thick, 10 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.4212 g Zirconium (IV) propoxide solution (70 wt. % in 1-propanol) is added to the refluxed Cu solution and the resulting solution is refluxed at 105° C. for 30 min to produce a second refluxed solution.

The second refluxed solution is evaporated to produce 10 ml of concentrated refluxed solution. Then, 20 ml of 2-methoxyethanol is added to the concentrated Zr doped Cu solution and stirred at 30-40° C.

The resulting Zr doped Cu solution is deposited onto a $SiO_2$/Si substrate by spin coating and spin coated as in example 1 to produce a film bearing substrate. The deposited film on the substrate then is pyrolyzed and annealed as in example 1 to produce a 10 m/o Zr doped Cu film having a thickness of 50 nm and a resistivity of 101 μΩ-cm as measured by the 4-point method.

Example 7

80 nm Thick, 15 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.6318 g Zirconium (IV) propoxide solution (70 wt. % in 1-propanol) is added to the refluxed Cu solution and refluxed at 105° C. for 30 min to produce a second refluxed Cu solution.

The second refluxed solution is evaporated to produce 10 ml of concentrated refluxed solution. Then, 20 ml of 2-methoxyethanol is added to the concentrated refluxed solution and stirred at 30-40° C.

The resulting Zr doped Cu solution is deposited onto a $SiO_2$/Si substrate and spin coated as in example 1 to produce a film bearing substrate. The deposited film on the substrate then is pyrolyzed and annealed as in example 1 to produce a 15 m/o Zr doped Cu film having a thickness of 80 nm and a resistivity of 17 μΩ-cm.

Example 7A 80 nm Thick, 15 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.6318 g Zirconium (IV) propoxide solution (70 wt. % in 1-propanol) is added to the refluxed Cu solution and the resulting solution is refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C. The resulting Zr doped Cu solution is deposited onto a $SiO_2$/Si substrate by spin coating as in example 1.

The deposited film on the substrate then is pyrolyzed as in example 1. The resulting pyrolyzed film annealed according to the modified annealing procedure of example 5A to produce a 15 m/o Zr doped Cu film having a thickness of 80 nm and a resistivity of 5 μΩ-cm as measured by the 4-point method.

Example 8

80 nm Thick, 20 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.8423 g Zirconium (IV) propoxide solution (70 wt. % in 1-propanol) is added to the refluxed Cu solution and the resulting solution is refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C. The resulting Zr doped Cu solution is deposited onto a $SiO_2$/Si substrate and spin coated as in example 1 to produce a film bearing substrate. The deposited film on the substrate then is pyrolyzed and annealed as in example 1 to produce a 20 m/o Zr doped Cu film having a thickness of 80 nm and a resistivity of 23 μΩ-cm.

Example 8A 80 nm Thick, 20 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 0.8423 g Zirconium (IV) propoxide solution (70 wt. % in 1-propanol) is added to the refluxed Cu solution and the resulting solution is refluxed at 105° C. for 30 min to produce a second refluxed solution.

The second refluxed solution is evaporated to produce 10 ml of concentrated refluxed solution. Then, 20 ml of 2-methoxyethanol is added to the refluxed Zr doped Cu solution and stirred at 30-40° C.

The refluxed Zr doped Cu solution is deposited onto a $SiO_2$/Si substrate and spin coated as in example 1 to produce a film bearing substrate. The deposited film on the substrate then is pyrolyzed and annealed as in example 1 to produce a 20 m/o Zr doped Cu film having a thickness of 80 nm and a resistivity of 7.6 μΩ-cm.

Example 9

80 nm Thick, 30 m/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 1.2635 g Zirconium (IV) propoxide solution (70 wt. % in 1-propanol) is added to the refluxed Cu solution and refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C.

The resulting Zr doped Cu solution is deposited onto a $SiO_2$/Si substrate and spin coated as in example 1 to produce a film bearing substrate. The deposited film on the substrate then is pyrolyzed and annealed as in example 1 to produce a 30 m/o Zr doped Cu film having a thickness of 80 nm and a resistivity of 46 μΩ-cm.

Example 9A 80 nm Thick, 30 ml/o Zr Doped Cu Film on $SiO_2$/Si Substrate 2.0933 gm copper nitrate hydrate is dissolved in 20 ml 2-methoxyethanol and the resulting Cu solution is refluxed at 105° C. for 60 min to produce a refluxed Cu solution. Then, 1.2635 g Zirconium (IV) propoxide solution (70 wt. % in 1-propanol) is added to the refluxed Cu solution and refluxed at 105° C. for 30 min to produce a second refluxed solution.

The second refluxed solution is evaporated to produce 10 ml of concentrated refluxed solution. Then, 20 ml of 2-methoxyethanol is added to the concentrated refluxed solution and stirred at 30-40° C.

The refluxed Zr doped Cu solution is deposited onto a $SiO_2$/Si substrate and spin coated as in example 1 to produce a film bearing substrate. The deposited film on the substrate then is pyrolyzed and annealed as in example 1 to produce a 30 m/o Zr doped Cu film having a thickness of 80 nm and a resistivity of 16 AC-cm as measured by the 4-point method.

Example 10

This Example Illustrates Manufacture of 10 m/o Zr Doped Ni—Cu Films of the Formula $Cu_{1-x}Ni_x$ where x=0.5

1.0466 gms copper nitrate hydrate and 1.3086 gms. nickel nitrate hexahydrate each are dissolved in 30 ml 2-methoxyethanol to produce a Cu—Ni solution. The Cu—Ni solution is refluxed at 105° C. for 60 min to produce a first refluxed Cu—Ni solution.

Then, 0.6318 g Zirconium (IV) propoxide solution (70 wt. % in 1-propanol) is added to the refluxed Cu—Ni solution and refluxed at 105° C. for 30 min to produce a second refluxed solution. The second refluxed solution is evaporated to produce 10 ml of concentrated refluxed solution.

Then, 20 ml of 2-methoxyethanol is added to the refluxed Zr doped Cu—Ni solution and stirred at 30-40° C. The refluxed Zr doped Cu solution is deposited onto a $SiO_2$/Si substrate and spin coated as in example 1 to produce a film bearing substrate. The deposited film on the substrate then is pyrolyzed and annealed as in example 1.

While the foregoing description and represents preferred embodiments of the invention, it will be understood that various additions, modifications and substitutions may be made therein without departing from the spirit and scope of the present invention as defined in the accompanying claims. In particular, it will be clear to those skilled in the art that the present invention may be embodied in other specific forms, structures, arrangements, proportions, and with other elements, materials, and components, without departing from the spirit or essential characteristics thereof. The presently disclosed embodiments are therefore to be considered in all respects as illustrative and not restrictive, the scope of the invention being indicated by the appended claims, and not limited to the foregoing description.

The invention claimed is:

1. A method of manufacture of a thin metal film comprising, forming a first solution of a metal precursor in a solvent selected from the group consisting of glycol ethers, lower alkanols, lower alkanoic acids, and mixtures thereof, refluxing the first solution to yield a refluxed metal solution, mixing a continuity dopant selected from the group consisting of Zr, Hf, Zn, Cd, P, Zr precursors, Hf precursors, Zn precursors, Cd precursors, P precursors and mixtures thereof with the refluxed metal solution to yield a doped solution, depositing the doped solution onto an insulating substrate to yield a wet film on the substrate, pyrolyzing the wet film to yield a pyrolyzed film, and annealing the pyrolyzed film in a reducing atmosphere, a inert atmosphere and mixtures thereof.

2. The method of claim 1 wherein the reducing atmosphere is selected from the group consisting of a mixtures of hydrogen, wet nitrogen and dry nitrogen, CO, mixtures of CO and $CO_2$, and mixtures thereof, and the inert atmosphere is selected from the group consisting of Ar, N, He, Kr and mixtures thereof.

3. The method of claim 1 or 2 wherein annealing is performed by heating the pyrolyzed film at about 1° C/min to about 50° C/min to a maximum temperature of about 400° C. to about 700° C., holding at that maximum temperature for about 1 min to about 120 min, and cooling at about 1° C/min to about 50° C/min to room temperature.

4. The method of claim 1 wherein the first solution further includes a high work function dopant.

5. The method of claim 1 wherein the metal precursor is selected from the group consisting of copper precursors, nickel precursors, silver precursors, palladium precursors and mixtures thereof.

6. The method of claim 1 or 5 wherein the glycol ether is selected from a group consisting of 2-ethoxyethanol, 2-propoxyethanol, 2-isopropoxyethanol, 2-butoxyethanol, 2-phenoxyethanol, 2-benzyloxyethanol diethylene glycol monoethyl ethyl and mixtures thereof.

7. The method of claim 1 or 5 wherein the lower alkanol is selected from the group consisting of methanol, ethanol, butanol, propanol and mixtures thereof.

8. The method of claim 1 or 5 wherein the lower alkanoic acid is selected from the group consisting of acetic acid, propionic acid, butyric acid, valeric acid, myristic acid, and mixtures thereof.

9. The method of claim 5 were the copper precursor is selected from the group consisting of copper acetate, copper acetylacetonate, copper hexafluoroacetylacetonate, copper nitrate hydrate, copper chloride, copper 2-ethylhexanoate and mixtures thereof.

10. The method of claim 5 wherein the nickel precursor is selected from the group consisting of nickel acetate, nickel acetylacetonate, nickel hexafluoroacetylacetonate, nickel nitrate hydrate, nickel chloride, nickel 2-ethylhexanoate, and mixtures thereof.

11. The method of claim 5 wherein the nickel precursor is nickel acetate, nickel acetylacetonate, nickel hexafluoroacetylacetonate, nickel nitrate hydrate, nickel chloride, nickel 2-ethylhexanoate, and mixtures thereof.

12. The method of claim 1 wherein depositing of the doped solution is performed by spin casting the doped solution at about 1000 RPM to 6000 RPM at a temperature of about 0° C. to about 90° C. for about 20 sec to about 200 sec onto an insulating substrate.

13. The method of claim 1 wherein pyrolyzing is performed at about 100° C. to about 500° C.

14. The method of claim 1 wherein annealing comprises a first step of heating the pyrolyzed film at about 1° C/min to about 600° C/min to a maximum temperature of about 300° C. to about 800° C., holding at the maximum temperature for about 1 min to about 120 min, cooling at about 1° C/min to about 600° C/min to room temperature, and holding at room temperature for 60 sec, followed by a second step wherein the film is heated at about 1° C/min to about 600° C/min to a maximum temperature of about 800° C. to about 1200° C., holding at the maximum temperature for about 1 min to about 120 min, and cooling at about 1° C/min to about 600° C/min, wherein the first step is performed in a reducing atmosphere and the second step is performed under reduced partial pressure of oxygen.

15. The method of claim 1 wherein the Zr precursor is selected from the group consisting of Zr propoxide, zirconium acetate, zirconium acetylacetonate, zirconium isopropoxide, zirconium chloride, and zirconium ethoxide, and mixtures thereof, and the Zn precursor is selected from the group consisting of zinc acetate, zinc acetylacetonate hydrate, zinc chloride and zinc acetate dihydrate, and mixtures thereof.

16. A method of manufacture of a Cu thin film having about 0.1 m/o to about 50 m/o of a Zn continuity dopant comprising, dissolving a Cu precursor selected from the group consisting of copper acetate, copper acetylacetonate, copper hexafluoroacetylacetonate, copper nitrate hydrate, copper chloride, copper 2-ethylhexanoate and mixtures thereof in a solvent selected from the group consisting of 2-methoxyethanol, 1-methoxy-2-butanol, 1-methoxy-2-propanol, 2-methoxyethanol, methanol, ethanol, butanol, propanol, acetic acid, propionic acid, butyric acid, valeric acid, myristic acid, and mixtures thereof to produce a Cu solution, refluxing the copper solution for about 0.1 hr to about 20 hrs at about 100° C. to about 160° C. to produce a first refluxed copper solution, adding a Zn continuity dopant precursor selected from the group consisting of zinc acetate, zinc acetylacetonate hydrate, zinc chloride and zinc acetate dihydrate and mixtures thereof, refluxing the first refluxed copper solution to produce a second refluxed solution, mixing the second refluxed solution with a glycol ether solvent at about 0° C. to about 100° C. to produce a Ti-doped copper solution, spin coating the Ti-doped copper solution onto an insulating substrate, at a temperature of about 0° C. to about 90° C.

pyrolyzing the film at about 150° C. to about 500° C., and annealing the film by heating at about 1° C./min to about 50° C./min to a maximum temperature of about 400° C. to about 700° C., holding at that maximum temperature for about 1 min to about 120 min, and cooling at about 1° C./min to about 50° C./min to room temperature in a reducing atmosphere formed of a mixture of hydrogen, wet nitrogen and dry nitrogen.

17. A method of manufacture of a Cu thin film having about 0.1 m/o to about 50 m/o of a Zr continuity dopant comprising dissolving a Cu precursor selected from the group consisting of copper acetate, copper acetylacetonate, copper hexafluoroacetylacetonate, copper nitrate hydrate, copper chloride, copper 2-ethylhexanoate and mixtures thereof in a solvent selected from the group consisting of 2-methoxyethanol, 1-methoxy-2-butanol, 1-methoxy-2-propanol, 2-methoxyethanol, methanol, ethanol, butanol, propanol, acetic acid, propionic acid, butyric acid, valeric acid, myristic acid, and mixtures thereof to produce a Cu solution, refluxing the copper solution for about 0.1 hr to about 20 hrs at about 100° C. to about 160° C. to produce a first refluxed copper solution, adding a Zr continuity dopant precursor selected from the group consisting of Zr propoxide, zirconium acetate, zirconium acetylacetonate, zirconium isopropoxide, zirconium chloride, and zirconium ethoxide and mixtures thereof to first refluxed copper solution, refluxing the first refluxed copper solution to produce a second refluxed solution, mixing the second refluxed solution with a glycol ether solvent at about 0 ° C. to about 100° C. to produce a Zr-doped copper solution, spin coating the Zr-doped copper solution onto an insulating substrate, at a temperature of about 0° C. to about 90° C.

pyrolyzing the film at about 150° C. to about 500° C., and annealing the film by heating at about 1° C./min to about 50° C./min to a maximum temperature of about 400° C. to about 700° C., holding at that maximum temperature for about 1 min to about 120 min, and cooling at about 1° C./min to about 50° C./min to room temperature in a reducing atmosphere formed of a mixture of hydrogen, wet nitrogen and dry nitrogen.

18. A method of making a Zr doped Ni-Cu films of the formula $Cu_{1-x}Ni_x$ where $0<x<1$ comprising, dissolving a copper precursor and a nickel precursor in a glycol ether solvent produce a Cu-Ni solution, refluxing the Cu-Ni solution to produce a first refluxed Cu-Ni solution.

adding a Zr continuity dopant precursor to the refluxed Cu-Ni solution to produce a second refluxed solution, depositing the second refluxed solution onto an insulating substrate to produce a wet film, heating the wet film to produce a pyrolyzed film, and annealing the pyrolyzed film.

* * * * *